US007927210B2

(12) United States Patent
Blackburn et al.

(10) Patent No.: US 7,927,210 B2
(45) Date of Patent: Apr. 19, 2011

(54) ACCOUNTING SERVICE IN A SERVICE-ORIENTED GAMING NETWORK ENVIRONMENT

(75) Inventors: Christopher W. Blackburn, Reno, NV (US); Rory L. Block, Carson City, NV (US); Chih-Hui Jan, Reno, NV (US); James P. Simmermon, Reno, NV (US); Thomas A. Gentles, Algonquin, IL (US); Vikram Swamy, Chicago, IL (US); Terry D. Warkentin, Carson City, NV (US)

(73) Assignee: WMS Gaming Inc., Waukegan, IL (US)

( * ) Notice: Subject to any disclaimer, the term of this patent is extended or adjusted under 35 U.S.C. 154(b) by 1064 days.

(21) Appl. No.: 10/802,699

(22) Filed: Mar. 17, 2004

(65) Prior Publication Data

US 2004/0248645 A1 Dec. 9, 2004

Related U.S. Application Data

(60) Provisional application No. 60/455,298, filed on Mar. 17, 2003.

(51) Int. Cl.
*A63F 9/24* (2006.01)

(52) U.S. Cl. ..... 463/29; 463/25; 463/42

(58) Field of Classification Search ..... 463/25, 463/29, 42, 40, 41; 705/1.1, 500; 709/201–203; 340/5.1, 999

See application file for complete search history.

(56) References Cited

U.S. PATENT DOCUMENTS

| | | | |
|---|---|---|---|
| 4,670,857 | A | 6/1987 | Rackman |
| 5,116,055 | A | 5/1992 | Tracy |
| 5,280,909 | A | 1/1994 | Tracy |
| 5,638,448 | A | 6/1997 | Nguyen |
| 5,823,879 | A | 10/1998 | Goldberg et al. |
| 5,964,660 | A | 10/1999 | James et al. |
| 5,971,271 | A | 10/1999 | Wynn et al. |
| 6,035,397 | A | 3/2000 | Campinos et al. |
| 6,135,887 | A | 10/2000 | Pease et al. |
| 6,178,510 | B1 | 1/2001 | O'Connor et al. |
| 6,183,366 | B1 | 2/2001 | Goldberg et al. |
| 6,203,010 | B1 | 3/2001 | Jorasch |

(Continued)

FOREIGN PATENT DOCUMENTS

WO WO-0148713 A1 7/2001

(Continued)

OTHER PUBLICATIONS

"U.S. Appl. No. 10/788,661, Response filed Sep. 17, 2007 to Non-Final Office Action mailed Jun. 15, 2007", 16 pgs.

(Continued)

*Primary Examiner* — David L Lewis
*Assistant Examiner* — Robert Mosser
(74) *Attorney, Agent, or Firm* — Schwegman, Lundberg & Woessner, P.A.

(57) ABSTRACT

An accounting service for a gaming network including gaming machines provides systems and methods for retrieving accounting information such as gaming machine meter information from gaming machines on the gaming network. The gaming services framework comprises a set of services, protocols, XML schemas, and methods for providing gaming system functionality in a distributed, network based architecture that includes gaming machines and servers. The systems and methods provide a service-oriented framework for gaming and property management based upon internetworking technology and web services concepts.

26 Claims, 5 Drawing Sheets

U.S. PATENT DOCUMENTS

| | | | | |
|---|---|---|---|---|
| 6,280,328 | B1 | 8/2001 | Holch et al. | |
| 6,390,917 | B1 | 5/2002 | Walker et al. | |
| 6,468,155 | B1 | 10/2002 | Zucker et al. | |
| 6,508,709 | B1 | 1/2003 | Karmarkar | |
| 6,645,077 | B2 | 11/2003 | Rowe | |
| 6,682,423 | B2 | 1/2004 | Brosnan et al. | |
| 6,790,142 | B2 | 9/2004 | Okada et al. | |
| 6,830,515 | B2 | 12/2004 | Rowe | |
| 6,887,154 | B1 | 5/2005 | Luciano, Jr. | |
| 6,890,259 | B2 | 5/2005 | Breckner et al. | |
| 6,908,391 | B2 * | 6/2005 | Gatto et al. | 463/42 |
| 6,916,247 | B2 | 7/2005 | Gatto et al. | |
| 6,935,958 | B2 | 8/2005 | Nelson | |
| 6,939,234 | B2 | 9/2005 | Beatty | |
| RE38,812 | E | 10/2005 | Acres et al. | |
| 6,997,803 | B2 | 2/2006 | LeMay et al. | |
| 7,025,674 | B2 | 4/2006 | Adams et al. | |
| 7,039,701 | B2 | 5/2006 | Wesley | |
| 7,043,641 | B1 | 5/2006 | Martinek | |
| 7,117,349 | B2 | 10/2006 | Chu et al. | |
| 7,131,909 | B2 | 11/2006 | Rowe | |
| 7,159,007 | B2 | 1/2007 | Stawikowski | |
| 7,168,089 | B2 | 1/2007 | Nguyen et al. | |
| 7,185,342 | B1 | 2/2007 | Carrer et al. | |
| 7,186,181 | B2 | 3/2007 | Rowe | |
| 7,188,085 | B2 | 3/2007 | Pelletier | |
| 2001/0039210 | A1 | 11/2001 | St. Denis | |
| 2001/0044339 | A1 | 11/2001 | Cordero et al. | |
| 2002/0013174 | A1 | 1/2002 | Kiyoshi | |
| 2002/0143819 | A1 | 10/2002 | Han et al. | |
| 2002/0147049 | A1 | 10/2002 | Carter, Sr. | |
| 2002/0155891 | A1 | 10/2002 | Okada et al. | |
| 2002/0161868 | A1 | 10/2002 | Paul et al. | |
| 2002/0165023 | A1 | 11/2002 | Brosnan et al. | |
| 2002/0174160 | A1 | 11/2002 | Gatto et al. | |
| 2003/0004961 | A1 | 1/2003 | Slothouber et al. | |
| 2003/0061404 | A1 | 3/2003 | Atwal et al. | |
| 2003/0064771 | A1 | 4/2003 | Morrow et al. | |
| 2003/0065805 | A1 | 4/2003 | Barnes, Jr. | |
| 2003/0084342 | A1 | 5/2003 | Girard | |
| 2003/0087683 | A1 | 5/2003 | Gatto et al. | |
| 2003/0088421 | A1 | 5/2003 | Maes et al. | |
| 2003/0100369 | A1 | 5/2003 | Gatto et al. | |
| 2003/0100370 | A1 | 5/2003 | Gatto et al. | |
| 2003/0100371 | A1 | 5/2003 | Gatto et al. | |
| 2003/0100372 | A1 | 5/2003 | Gatto et al. | |
| 2003/0188019 | A1 | 10/2003 | Wesley | |
| 2003/0208638 | A1 | 11/2003 | Abrams et al. | |
| 2003/0217139 | A1 | 11/2003 | Burbeck et al. | |
| 2003/0220835 | A1 | 11/2003 | Barnes, Jr. | |
| 2003/0228907 | A1 | 12/2003 | Gatto et al. | |
| 2003/0229900 | A1 | 12/2003 | Reisman | |
| 2004/0003039 | A1 | 1/2004 | Humphrey et al. | |
| 2004/0015608 | A1 | 1/2004 | Ellis et al. | |
| 2004/0031058 | A1 | 2/2004 | Reisman | |
| 2004/0063497 | A1 | 4/2004 | Gould | |
| 2004/0087367 | A1 | 5/2004 | Hendrickson | |
| 2004/0106454 | A1 | 6/2004 | Walker et al. | |
| 2004/0127277 | A1 | 6/2004 | Walker et al. | |
| 2004/0142744 | A1 | 7/2004 | Atkinson et al. | |
| 2004/0158471 | A1 | 8/2004 | Davis et al. | |
| 2004/0193867 | A1 | 9/2004 | Zimmer et al. | |
| 2004/0198496 | A1 | 10/2004 | Gatto et al. | |
| 2005/0027871 | A1 | 2/2005 | Bradley et al. | |
| 2005/0032577 | A1 | 2/2005 | Blackburn et al. | |
| 2005/0054445 | A1 | 3/2005 | Gatto et al. | |
| 2005/0086286 | A1 | 4/2005 | Gatto et al. | |
| 2005/0088980 | A1 | 4/2005 | Olkkonen et al. | |
| 2005/0227768 | A1 | 10/2005 | Blackburn et al. | |
| 2006/0142086 | A1 | 6/2006 | Blackburn et al. | |
| 2006/0143085 | A1 | 6/2006 | Adams et al. | |
| 2006/0242072 | A1 | 10/2006 | Peled et al. | |
| 2007/0060381 | A1 | 3/2007 | Weiss | |
| 2007/0105613 | A1 | 5/2007 | Adams et al. | |
| 2007/0111787 | A1 | 5/2007 | Adams et al. | |
| 2007/0123332 | A1 | 5/2007 | Hishinuma et al. | |
| 2007/0123348 | A1 | 5/2007 | Nozaki | |
| 2007/0123349 | A1 | 5/2007 | Hishinuma et al. | |

FOREIGN PATENT DOCUMENTS

| | | | |
|---|---|---|---|
| WO | WO-03045516 | A1 | 5/2003 |
| WO | WO-03045515 | A1 | 6/2003 |
| WO | WO-03045517 | A1 | 6/2003 |
| WO | WO-03045518 | A1 | 6/2003 |
| WO | WO-2004004855 | A1 | 1/2004 |

OTHER PUBLICATIONS

"U.S. Appl. No. 10/788,661, Restriction Requirement mailed Nov. 28, 2007", 4 pgs.
"U.S. Appl. No. 10/788,661 Non Final Office Action mailed Jun. 15, 2007", 11 pgs.
"U.S. Appl. No. 10/788,902 Final Office Action mailed May 17, 2007", 17 pgs.
"U.S. Appl. No. 10/788,902 Non Final Office Action mailed Nov. 21, 2006", 19 pgs.
"U.S. Appl. No. 10/788,902 Response filed Feb. 21, 2007 to Non Final Office Action mailed Nov. 21, 2006", 15 pgs.
"U.S. Appl. No. 10/788,902, Response filed Aug. 17, 2007 in response to Final Office Action mailed May 17, 2007", 13 pgs.
"U.S. Appl. No. 10/788,902, Non-Final Office Action mailed Oct. 30, 2007", OARN,18 Pages.
"U.S. Appl. No. 10/788,903 Non Final Office Action mailed Jan. 3, 2007", 21 pgs.
"U.S. Appl. No. 10/788,903 Non Final Office Action mailed Jun. 28, 2007", 16 pgs.
"U.S. Appl. No. 10/788,903 Response filed Apr. 9, 2007 to Non Final Office Action mailed Jan. 3, 2007", 22 pgs.
"U.S. Appl. No. 10/788,903, Response filed Sep. 28, 2007 to Non-Final Office Action mailed Jun. 28, 2007", 13 pgs.
"U.S. Appl. No. 10/789,957 Non Final Office Action mailed May 16, 2007", 27 pgs.
"U.S. Appl. No. 10/789,957 Response filed Aug. 16, 2007 to Non Final Office Action mailed May 16, 2007", 17 pgs.
"U.S. Appl. No. 10/794,422, Response filed Nov. 19, 2007 to Non-Final Office Action mailed Jul. 18, 2007", 11 pgs.
"U.S. Appl. No. 10/794,422 Non Final Office Action Mailed Jul. 18, 2007", 9 pgs.
"U.S. Appl. No. 10/794,422 Final Office Action mailed Feb. 15, 2008.", FOAR,11 pgs.
"U.S. Appl. No. 10/794,423, Response filed Nov. 20, 2007 to Non-Final Office Action mailed Jul. 20, 2007", 12 pgs.
"U.S. Appl. No. 10/794,423 Non Final Office Action Mailed Jul. 20, 2007", 10 pgs.
"U.S. Appl. No. 10/794,423, Final Office Action mailed Feb. 15, 2008", FOAR,12 Pgs.
"U.S. Appl. No. 10/796,562, Non-Final Office Action mailed Nov. 27, 2007", OARN,7 pgs.
"U.S. Appl. No. 10/802,700, Non-Final Office Action mailed Sep. 12, 2008", 7 pgs.
"U.S. Appl. No. 10/802,701, Response filed Oct. 25, 2007 to Final Office Action mailed Jul. 25, 2007", 9 pgs.
"U.S. Appl. No. 10/802,701 Final Office Action Mailed Jul. 25, 2007", 8 pgs.
"U.S. Appl. No. 10/802,701 Non Final Office Action mailed Jan. 3, 2007", 9 pgs.
"U.S. Appl. No. 10/802,701 Response filed May 3, 2007 to Non Final Office Action mailed Jan. 3, 2007", 12 pgs.
"U.S. Appl. No. 10/802,701 Non- Final Office Action mailed Feb. 11, 2008.", OARN,13 pgs.
"U.S. Appl. No. 10/813,653 Non-Final Office Action mailed Nov. 7, 2007", OARN,13 pgs.
"U.S. Appl. No. 10/813,653, Response filed Sep. 10, 2007 to Final Office Action mailed Jun. 8, 2007", 10 pgs.
"U.S. Appl. No. 10/813,653 Final Office Action mailed Jun. 8, 2007", 11 pgs.
"U.S. Appl. No. 10/813,653 Non Final Office Action mailed Nov. 13, 2006", 10 pgs.
"U.S. Appl. No. 10/813,653 Response filed Feb. 13, 2007 to Non Final Office Action mailed Nov. 13, 2006", 13 pgs.
"U.S. Appl. No. 10/824,780 Non Final Office Action mailed May 17, 2007", 12 pgs.

"U.S. Appl. No. 10/824,780 Response filed Aug. 6, 2007 to Non Final Office Action mailed May 17, 2007", 17 pgs.
"U.S. Appl. No. 10/824,930, Non-Final Office Action Mailed Aug. 10, 2007", 13 pgs.
"U.S. Appl. No. 10/824,930 response filed 12/10/07 to Office Action Mailed Aug. 10, 2007.", 15 pgs.
"U.S. Appl. No. 11/068,065, Response filed Oct. 22, 2007 to Non-Final Office action mailed May 8, 2007", 11 pgs.
"U.S. Appl. No. 11/068,065 Non Final Office Action mailed Apr. 20, 2007", 13 pgs.
"U.S. Appl. No. 11/068,065 Non Final Office Action mailed May 8, 2007", 13 pgs.
"U.S. Appl. No. 10/788,903, Final Action Action Mailed Dec. 31, 2007", 16Pages.
"U.S. Appl. No. 11/068,065 Final Office Action mailed Jan. 9, 2008", FOAR,15 pgs.
"FAQs", http://web.archive.org/web/20011024231452/http://uddi.orq/faqs.html, (archived Oct. 25, 2001), 10 pgs.
"UDDI: Frequently Asked Question [online]", *Microsoft*, 7 pages, Dec. 4, 2002.
"UDDI: Frequently Asked Questions [online]", *Microsoft*, <http://www.microsoft.com/windowsserver2003/evaluation/overview/dotnet/uddifaq.mspx>,(Dec. 4, 2002).
Gottschalk, K. , et al., "Introduction to Web Systems Architecture", *IBM Systems Journal*;41(52), (2002), 170-177.
Ogbuji, U. , "Using WSDL in SOAP Applications", *IBM_developerWorks*:http://web.archive.org/web/20010820205450/www-106.ibm.com/developerworks/webserices/library/ws-soap/index.html?dwzone=webservices, (Nov. 2000),5 pgs.
Prescod, P. , "Second Generation Web Serviced", http://webservices.xml.com/Ipt/a/915, (Feb. 6, 2002),7 pgs.
Vasudevan, V. , "A Web Services Primer", http://www.xml.com/Ipt/a/760, (Apr. 4, 2001),10 pgs.

* cited by examiner

ACCOUNTING SERVICE IN A SERVICE-ORIENTED GAMING NETWORK ENVIRONMENT

CROSS-REFERENCE TO RELATED APPLICATIONS

This application claims the benefit of U.S. Provisional Patent Application Ser. No. 60/455,298, entitled "ACCOUNTING SERVICE IN A SERVICE-ORIENTED GAMING NETWORK ENVIRONMENT", filed Mar. 17, 2003; and is related to U.S. patent application Ser. No. 10/788,903, entitled "A SERVICE-ORIENTED GAMING NETWORK ENVIRONMENT", filed on Feb. 26, 2004 and assigned to the same assignee as the present application; each of which are hereby incorporated by reference herein for all purposes.

FIELD

The present invention relates generally to software and hardware systems for gaming machines and gaming machine networks, and more particularly to providing an accounting service in a service-oriented gaming network environment.

BACKGROUND

Today's gaming terminal typically comprises a computerized system controlling a video display or reels that provide wagering games such as video and mechanical slots, video card games (poker, blackjack etc.), video keno, video bingo, video pachinko and other games typical in the gaming industry. In addition, support computing systems such as accounting, player tracking and other "back office" systems exist in order to provide support for a gaming environment.

In order to prevent players from becoming bored, new versions of wagering games, and alterations to existing games are constantly being developed. In the past, the game software and content for gaming terminals and back office systems have been developed using proprietary or closed hardware, operating systems, application development systems, and communications systems. Sometimes these systems are provided by a single vendor.

Unfortunately, due to the proprietary and closed nature of existing architectures, it can be difficult to develop new games, and it is difficult to add games to existing proprietary game architectures. As a result, the cost and time associated with updating and adding new games to gaming networks is relatively high.

Additionally, it is common for gaming machines and service providers to maintain accounting information. However, it can be difficult and time consuming exchange accounting information between disparate machines and services that use proprietary network architectures.

In view of the above-mentioned problems and concerns, there is a need in the art for the present invention.

SUMMARY

The above-mentioned shortcomings, disadvantages and problems are addressed by the present invention, which will be understood by reading and studying the following specification.

One aspect of the systems and methods described below relates to providing an accounting service in a gaming network. The gaming network may comprise gaming machines, service providers, and other entities. The entities participating in the gaming network may implement a Gaming Services Framework using the World Wide Web and internetworking technology. The World Wide Web ("Web" from here on) is a networked information system comprising agents (clients, servers, and other programs) that exchange information. The Web and networking architecture is the set of rules that agents in the system follow, resulting in a shared information space that scales well and behaves predictably.

The Gaming Services Framework comprises a set of services, protocols, XML schemas, and methods for providing secure gaming system functionality in a distributed, network based architecture. It is intended to be a service-oriented framework for gaming and property management based upon internetworking technology and web services concepts. Specifically, it supports a loosely coupled architecture that consists of software components that semantically encapsulate discrete functionality (self contained and perform a single function or a related group of functions—the component describes its own inputs and outputs in a way that other software can determine what it does, how to invoke its functionality, and what result to expect). These components are distributed and programmatically accessible (called by and exchange data with other software) over standard internetworking protocols (TCP/IP, HTTP, DNS, DHCP, etc.).

The present invention describes systems, methods, and computer-readable media of varying scope. In addition to the aspects and advantages of the present invention described in this summary, further aspects and advantages of the invention will become apparent by reference to the drawings and by reading the detailed description that follows.

DETAILED DESCRIPTION

Figure 1:
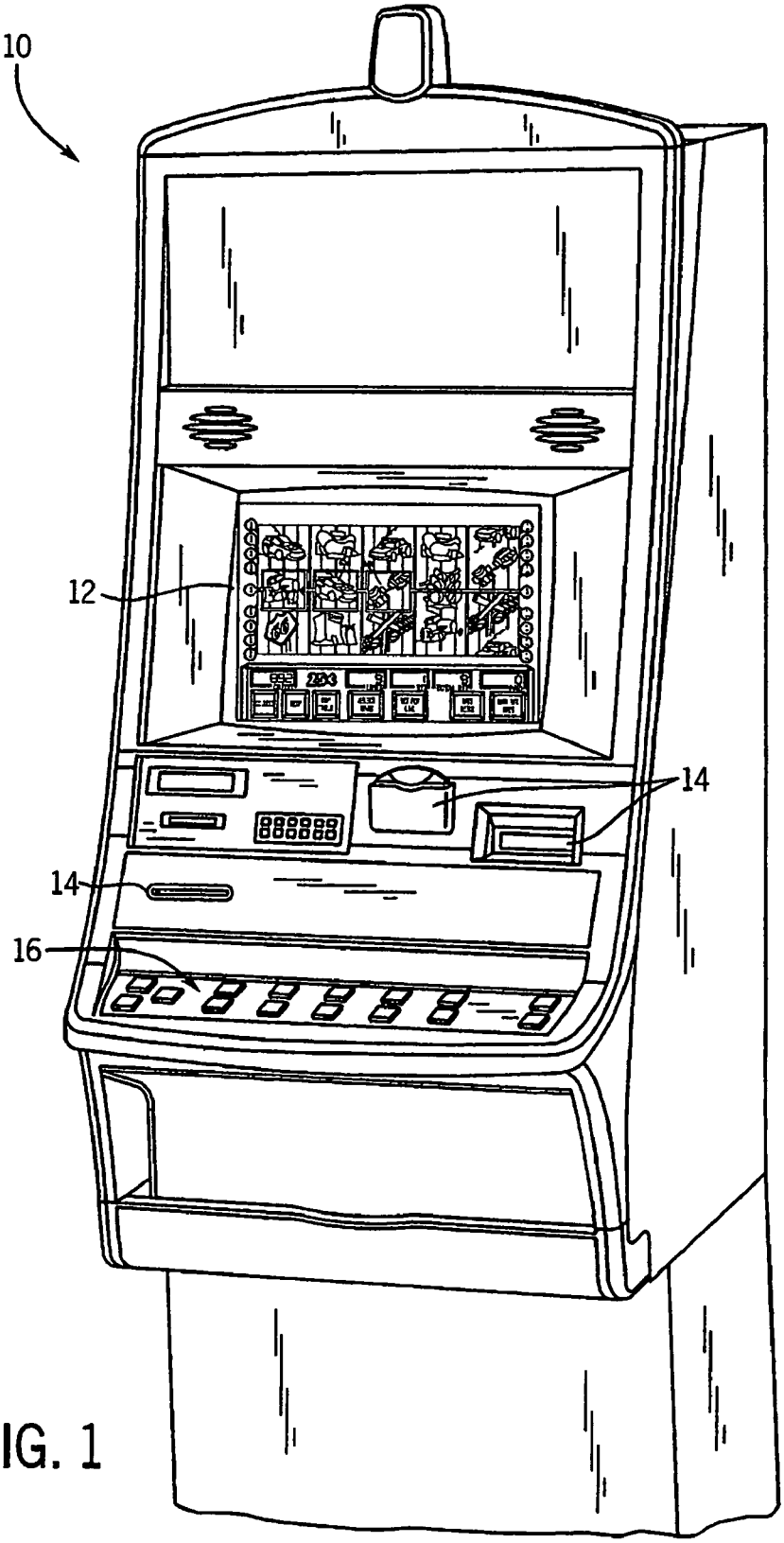
FIG. 1 is a perspective view of an exemplary gaming machine incorporated in the present invention.

In the following detailed description of exemplary embodiments of the invention, reference is made to the accompanying drawings which form a part hereof, and in which is shown by way of illustration specific exemplary embodiments in which the invention may be practiced. These embodiments are described in sufficient detail to enable those skilled in the art to practice the invention, and it is to be understood that other embodiments may be utilized and that logical, mechanical, electrical and other changes may be made without departing from the scope of the present invention.

Some portions of the detailed descriptions which follow are presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities. Unless specifically stated otherwise as apparent from the following discussions, terms such as "processing" or "computing" or "calculating" or "determining" or "displaying" or the like, refer to the action and processes of a computer system, or similar computing device, that manipulates and transforms data represented as physical (e.g., electronic) quantities within the computer system's registers and memories into other data similarly represented as physical quantities within the computer system memories or registers or other such information storage, transmission or display devices.

In the Figures, the same reference number is used throughout to refer to an identical component which appears in multiple Figures. Signals and connections may be referred to by the same reference number or label, and the actual meaning will be clear from its use in the context of the description.

The description of the various embodiments is to be construed as exemplary only and does not describe every possible instance of the invention. Numerous alternatives could be implemented, using combinations of current or future technologies, which would still fall within the scope of the claims. The present invention is directed to a service-oriented framework for gaming networks that allows for the interoperability of the software components (regardless of manufacturer, operating system, or application) reducing the dependence on a closed-system, single vendor solutions and allowing for variety in innovation and competition.

The following detailed description is, therefore, not to be taken in a limiting sense, and the scope of the present invention is defined only by the appended claims.

Operating Environment

FIG. 1 illustrates an exemplary gaming machine 10 in which embodiments of the invention may be implemented. In some embodiments, gaming machine 10 is operable to conduct a wagering game. These wagering games may include reel based games such as video or mechanical slot machine games, card based games such as video poker, video dice games (e.g. a Yahtzee® like dice game) or other types of wagering games typical in the gaming industry. If based in video, the gaming machine 10 includes a video display 12 such as a cathode ray tube (CRT), liquid crystal display (LCD), plasma, or other type of video display known in the art. A touch screen preferably overlies the display 12. In the illustrated embodiment, the gaming machine 10 is an "upright" version in which the display 12 is oriented vertically relative to a player. Alternatively, the gaming machine may be a "slant-top" version in which the display 12 is slanted at about a thirty-degree angle toward the player.

The gaming machine 10 includes a plurality of possible credit receiving mechanisms 14 for receiving credits to be used for placing wagers in the game. The credit receiving mechanisms 14 may, for example, include a coin acceptor, a bill acceptor, a ticket reader, and a card reader. The bill acceptor and the ticket reader may be combined into a single unit. The card reader may, for example, accept magnetic cards and smart (chip) cards coded with money or designating an account containing money.

In some embodiments, the gaming machine 10 includes a user interface comprising a plurality of push-buttons 16, the above-noted touch screen, and other possible devices. The plurality of push-buttons 16 may, for example, include one or more "bet" buttons for wagering, a "play" button for commencing play, a "collect" button for cashing out, a help" button for viewing a help screen, a "pay table" button for viewing the pay table(s), and a "call attendant" button for calling an attendant. Additional game specific buttons may be provided to facilitate play of the specific game executed on the machine. The touch screen may define touch keys for implementing many of the same functions as the push-buttons. Additionally, in the case of video poker, the touch screen may implement a card identification function to indicate which cards a player desires to keep for the next round. Other possible user interface devices include a keyboard and a pointing device such as a mouse or trackball.

A processor controls operation of the gaming machine 10. In response to receiving a wager and a command to initiate play, the processor randomly selects a game outcome from a plurality of possible outcomes and causes the display 12 to depict indicia representative of the selected game outcome. In the case of slots for example mechanical or simulated slot reels are rotated and stopped to place symbols on the reels in visual association with one or more pay lines. If the selected outcome is one of the winning outcomes defined by a pay table, the processor awards the player with a number of credits associated with the winning outcome.

Figure 2:
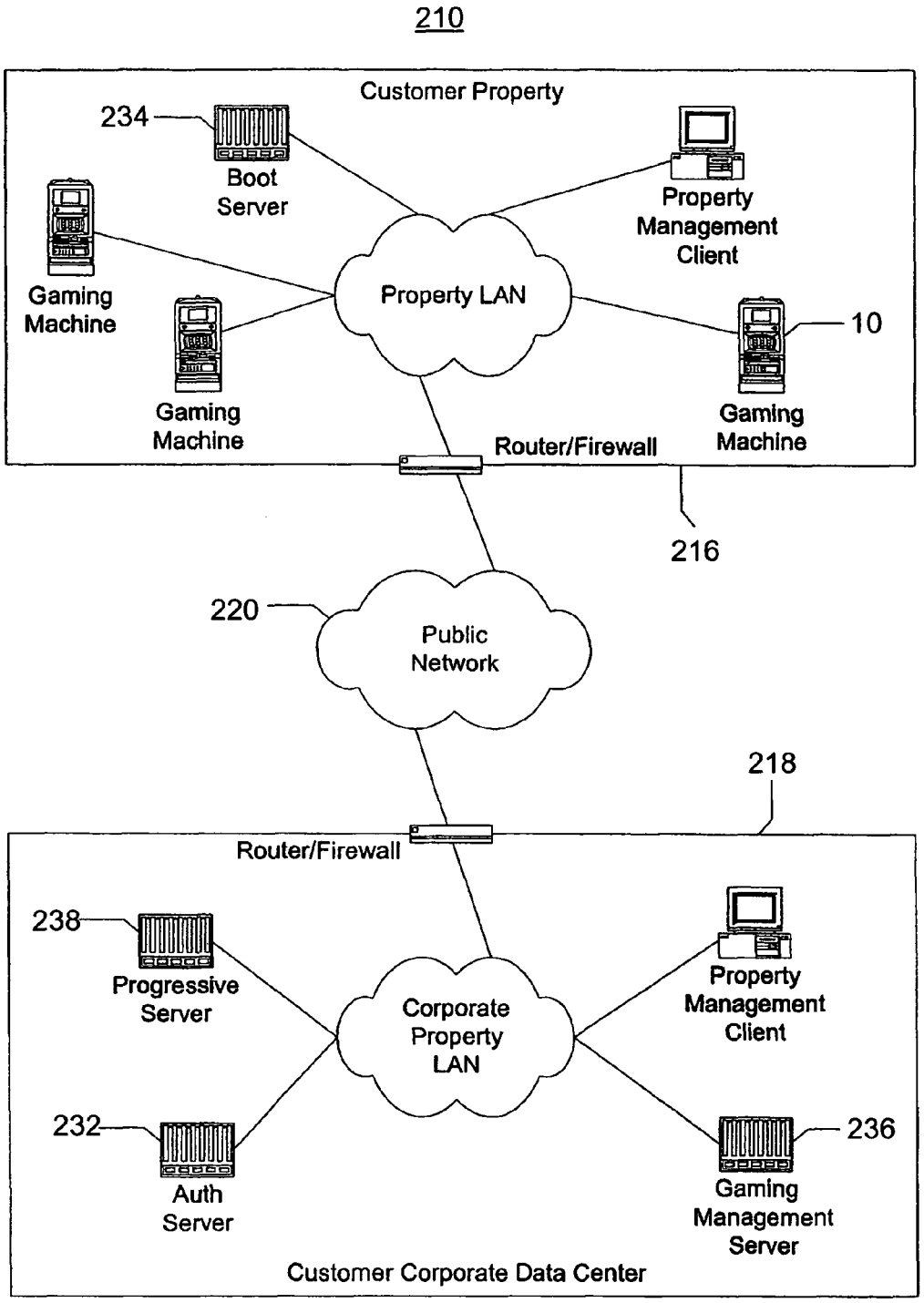
FIG. 2 is a block diagram providing an example of a service-oriented network for distributed management in a gaming environment.

FIG. 2 illustrates an example of a Gaming Service Network 210 comprising a customer data center 218 and a customer property 216. The data center 218 and customer property 216 are connected via a network 220. In some embodiments, network 220 is a public network such as the Internet. However, in alternative embodiments, private networks, including corporate intranets or extranets may be used to connect a data center 218 with one or more properties 216.

In some embodiments, the Customer Corporate Data Center 218 contains the bulk of the network servers supporting gaming properties owned by the corporation. Major elements of the gaming service network include Auth server 232, Gaming Management Server 236, and Progressive Server 238. In some embodiments, Auth Server 32 provides authentication, authorization and content integrity for client devices attempting to interact with other servers and services in the architecture.

In some embodiments, the Gaming Management Server 236 includes the following services: Boot Service, Name Service, Time Service, Game Management Service, Game Update Service, Event Management Service, Accounting Service, and Discovery Service.

In some embodiments, the Progressive Server 238 hosts a value-add service that allows a gaming machine to participate within a progressive gaming offering. Any value-add service can be added or substituted for this server/service. A progressive game offering is provided as an example. Other value-add services can be distributed on existing servers or reside on a newly added server.

The Customer Property 16 contains gaming machines 10, which in some embodiments allow remote updates and configuration through a network interface on the gaming machine. In some embodiments, a Boot Server 234 contains a DHCP service that facilitates the distribution of IP addressing to the gaming machines 10. It should be noted that any device capable of supporting a wagering game could be substituted for gaming machine 10. For example, a personal or laptop computer executing a wagering game may participate in the gaming network using the services described below.

As noted above, various services may be located throughout the gaming network. In some embodiments of the invention, a set of core operational services may include one or more of the following services:

| | |
|---|---|
| Boot Service | Provides dynamic IP addressing to devices upon boot (start-up). Typically supported by Dynamic Host Configuration Protocol (DHCP). |
| Discovery Service | Provides the address information of the server containing the service when prompted by the requestor as well as the service description, binding and location on the server. |
| Authentication Service | Contains the master Authentication Database. Authenticates the service user before allowing the use of services in the Gaming Services Framework. |
| Authorization Service | Contains the master Authorization Database. Authorizes the use of services in the Gaming Services Framework by a service requestor. |
| Gaming Management Service | Provides the ability to configure and monitor gaming machines and other services from a central location. |
| Name Service | Provides name resolution service to enable machines in a gaming network to refer to each other by name instead of an IP Address. In some embodiments the name service is implemented in part using the Domain Naming System (DNS) protocol. |
| Time Service | Provides global synchronization of time in the gaming network. This may be implemented by running the Network Time Protocol (NTP) client software on gaming machines. |

In addition to or instead of the core services described above, some embodiments of the invention include one or more of the following services referred to as Basic Gaming Services:

| | |
|---|---|
| Accounting Service | Provides logging of transaction records for billing and general tracking purposes. |
| Event Management Service | Logs events occurring at client and server machines. |
| Game Update Service | Provides dynamic distribution of new or updated game content to gaming machines. |
| Message Director Service | This service uses a software-configurable message routing application to facilitate the reliable exchange of data messages among multiple application processes within one or more gaming systems. |
| Content Integrity Service | This service provides the ability to verify the integrity of software components running in the gaming network. This includes the verification of software versions running on gaming machines, peripherals, services as well the detection of tampering or modification of the software. |

Further details of an accounting service according to embodiments of the invention are provided below with reference to FIGS. 5A-5B.

As noted above, a gaming service network may include Value Add Services. These services include participation services and player services. Examples of participation services that may be included in various embodiments of the invention include the following:

| | |
|---|---|
| Progressive Service | Provides functionality for a gaming machine to participate within a single progressive or multiple progressives. Further details on the progressive service described above are provided below with reference to FIGS. 5A and 5B. |
| Wide Area Disruption Progressive Service | This service takes over the processing of wide area progressives at each gaming site in the event that there is no connection with a central system or the connection with the central system is temporarily disabled. |
| Mobile Gaming Device GPS Service | This service processes the GPS location of gaming machines compared with coordinates of a gaming jurisdiction. Example: players can ride a bus and begin gambling on the bus when the bus crosses into the gaming jurisdiction. |

Examples of Player Services that may be included in various embodiments of the invention include:

| | |
|---|---|
| Player Tracking Service | This service provides the operator and player with standard player tracking applications such as monitoring card in / card out transactions to track play and award player points for play, providing targeted promotional compensation to specific players, publishing account status to the player or operator, providing temporary gaming machine locking in order to hold the machine for the player for short periods of time, and providing operators and players an interface and capability for Responsible Gaming Initiatives. |
| Game Theme Location Service | This service provides location information to clients regarding specific games, game themes or vendor brands. The service may publish the information by casino, by area, by city, by state, by region, by country, or by continent depending on the input parameters provided. An example would be to publish where all of the progressive games of a particular theme (e.g., "Monopoly Money") are located in a particular hotel (e.g., the Reno Hilton) in Reno, Nevada. |
| Personalization Service | This service provides the gaming player with a more personalized gaming environment. Example: the player could choose to see text in Chinese, could choose to be reminded of dinner reservation time, could customize machine graphics, or could have a portion of his coin in go to his football club's progressive. |
| Cashless Transaction Service | This service provides the ability for a player to transfer funds between financial institutions, in-house accounts and gaming machines. |
| Bonusing Service | This service provides the ability for casinos to set up bonus games for a specific gaming machine, carousel of machines or one or more game themes. |
| Game Service | This service is a server-side process that provides the outcome of game play. This service may be used to enable Internet/ online gaming. |
| Advertising Service | This service allows the operator to display advertising information to players in multimedia format as well as simple audio and graphic formats. |
| Property Service | This is a group of services that provides the ability for the property management company to integrate with gaming systems. It can provide interaction with functions such as hotel and restaurant reservations. |

It should be noted that with the distributed architecture of the Gaming Service Network 210, the above-described services that reside on network servers are not limited to location and can reside anywhere the network supports. For example, it is desirable to consider security and network latency when locating services.

Figure 3:
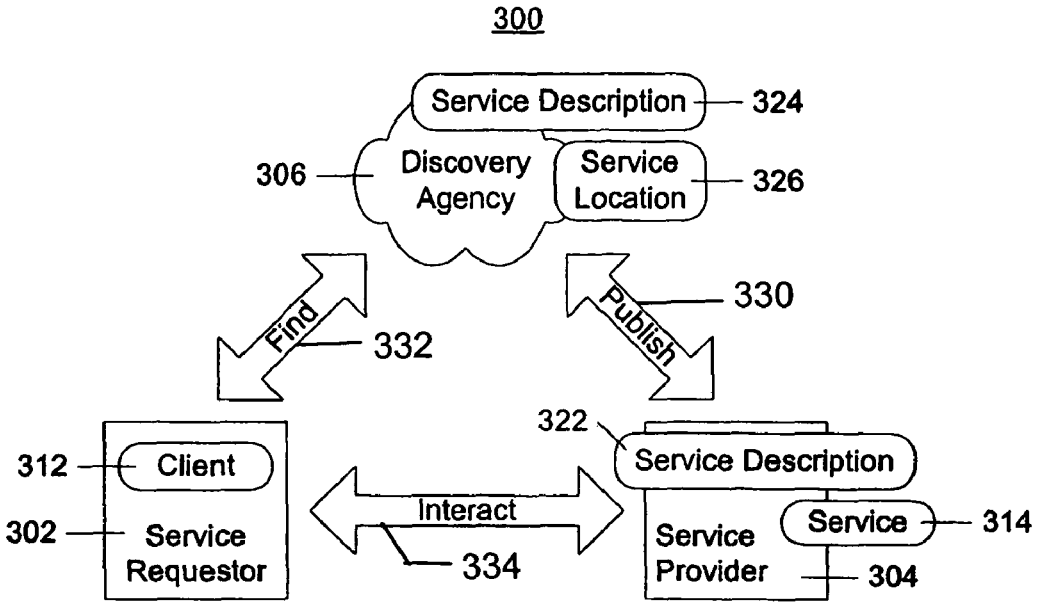
FIG. 3 is a block diagram providing general description of service-oriented discovery and interaction.

FIG. 3 is a block diagram of a Gaming Services Framework 300 according to various embodiments of the invention. In some embodiments, the Gaming Services Framework 300 includes a set of protocols, XML schemas, and methods for providing gaming system functionality in a distributed, network-based architecture such as the network described above in FIG. 2. In order to participate in such network-based architectures, the participating machines are interconnected via public or private networks that may be wired or wireless networks. Further, devices performing service communication support a common services protocol stack such as the Gaming Services Protocol Stack that is further described below.

The Gaming Services Framework 300 provides for the interaction of several logical elements as depicted in FIG. 3. Logical elements represent the fundamental entities that interact to implement a service. In some embodiments, these logical elements include Service Requestor 302, Service Provider 304, and Discovery Agency 306. In general terms, the roles these elements play are as defined in Web Services Architecture—W3C Working (Draft 14 Nov. 2002 and later versions). Further details on these elements are provided below.

Logical elements may reside in a number of different physical devices as part of delivering any service. For example, a Service Provider 304 will typically reside in a slot accounting or player tracking system and the Service Requestor 302 will typically reside in a gaming machine. However, there may be scenarios where it would be advantageous or appropriate for the logical elements to reside in other physical devices. For example, in alternative embodiments a Service Requestor 302 may reside in a slot accounting system.

Service Provider 304 comprises a platform that hosts access to a service 314. A service provider may also be referred to as a service execution environment or a service container. Its role in the client-server message exchange patterns is that of a server.

Service Requestor 302 comprises an application that is looking for and invoking or initiating an interaction with a service such as that provided by service provider 304. Its role in the client-server message exchange patterns is that of a client 312.

Discovery Agency 306 comprises a searchable set of service descriptions where service providers 304 publish their service description(s) 324 and service location(s) 326. The service discovery agency 306 can be centralized or distributed. A discovery agency 306 can support both patterns where service descriptions 322 are sent to discovery agency 306 and patterns where the discovery agency 306 actively inspects public service providers 304 for service descriptions 322. Service requestors 302 may find services and obtain binding information (in the service descriptions 324) during development for static binding, or during execution for dynamic binding. In some embodiments, for example in statically bound service requestors, the service discovery agent may be an optional role in the framework architecture, as a service provider 304 can send the service description 322 directly to service requestor 302. Likewise, service requestors 302 can obtain a service description 324 from other sources besides a discovery agency 306, such as a local file system, FTP site, URL, or WSDL document.

Figure 4:
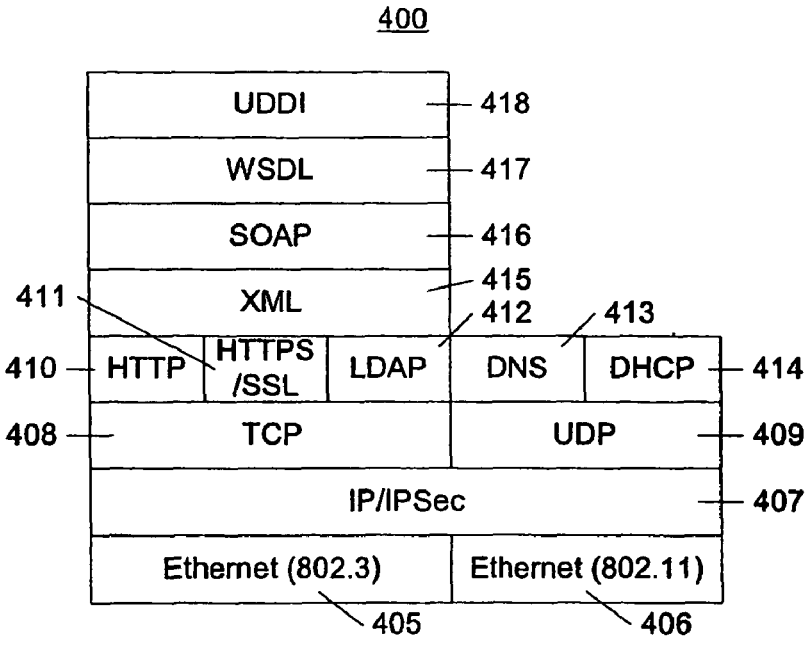
FIG. 4 is a representation of a Gaming Services Protocol Stack according to embodiments of the invention.

FIG. 4 provides a block diagram of a Gaming Services Protocol Stack 400 according to embodiments of the invention. In some embodiments, the protocol stack includes core layers that define basic services communication and transport, and are typically implemented uniformly. Higher layers that define strategic aspects of gaming processes are also described below. FIG. 4 illustrates both the widely implemented core layers and in addition illustrates the higher gaming services oriented layers of the protocol stack.

Core Layers of the Gaming Services Protocol Stack 400

In some embodiments, the gaming services framework utilizes common Internet protocols, which may include web services protocols. Although not specifically tied to any transport protocol, it is desirable to build the gaming services on ubiquitous Internet connectivity and infrastructure to ensure nearly universal reach and support. In some embodiments, gaming services will take advantage of Ethernet 405 or 406, Transmission Control Protocol (TCP) 408, Internet Protocol (IP) 407, User Datagram Protocol (UDP) 409, HyperText Transfer Protocol (HTTP) 410, HyperText Transfer Protocol Secure/Secure Socket Layer (HTTPS/SSL) 411, Lightweight Directory Access Protocol (LDAP) 412, Domain Naming System (DNS) 413, and Dynamic Host Configuration Protocol (DHCP) 414 layers in the protocol stack 400. Those of skill in the art will appreciate that other protocol layers performing equivalent functionality may be substituted for those described above and are within the scope of the present invention.

In some embodiments, service request and response data are formatted using Extensible Markup Language (XML) 415. XML 415 is a widely accepted format for exchanging data and its corresponding semantics. XML is a fundamental building block used in layers above the Common Internet Protocols. In some embodiments, the Gaming Services Protocol Stack 400 incorporates this protocol in accordance with the World Wide Web Consortium (W3C) XML Working Group's XML specification. However, those of skill in the art will appreciate that other data exchange formats may be substituted for XML 415, and such formats are within the scope of the present invention.

In some embodiments of the invention, the gaming service protocol stack 400 utilizes the Simple Object Access Protocol (SOAP) 416. SOAP 416 is a protocol for messaging and RPC (Remote Procedure Call) style communication between applications. SOAP is based on XML 415 and uses common Internet transport protocols like HTTP 410 to carry data. SOAP 416 may be used to define a model to envelope request and response messages encoded in XML 415. SOAP 416 messaging can be used to exchange any kind of XML 415 information. SOAP 416 is used in some embodiments as the basic standard for carrying service requests/responses between service users and providers. SOAP 416 has been submitted to the World Wide Web Consortium (W3C) standards body as recommendation documents (versions 1.1 and 1.2) and will likely emerge as "XML Protocol (XP)."

Higher Layers of the Gaming Services Protocol Stack 400

In some embodiments, the gaming services protocol stack includes a Web Services Description Language (WSDL) 417 and a Universal Description, Discovery, and Integration (UDDI) 418. WSDL 417 comprises a description of how to connect to a particular service. In some embodiments, WSDL 417 is based on XML. A WSDL 417 description abstracts a particular service's various connection and messaging protocols into a high-level bundle and forms an element of the UDDI 418 directory's information. WSDL 417 is similar to CORBA or COM IDL in that WSDL 417 describes programmatic interfaces. WSDL 417 is typically independent of the underlying service implementation language or component model, and focuses on an abstract description. The Gaming Services Protocol Stack 400 incorporates this description in accordance with the World Wide Web Consortium (W3C) Web Services Description Language (WSDL) 1.1-W3C Note 15 Mar. 2001 and later versions.

In some embodiments, UDDI 418 represents a set of protocols and a public directory for the registration and real-time lookup of services. UDDI 418 enables an entity such as a company to publish a description of available services to the registry, thereby announcing itself as a service provider. Service users can send requests conforming to the UDDI 418 schema as SOAP 416 messages to the service registry to discover a provider for services. Some embodiments of the present invention may utilize UDDI Version 3, released in July of 2002 and later versions. Further development of UDDI 418 is managed under the auspices of the OASIS (Organization for the Advancement of Structured Information Standards) UDDI Specifications technical committee.

Returning to FIG. 3, the service requestors and service providers use the above-described protocol stack to perform service interactions with one another. The service interactions include publish 330, discover (find) 332, and interact 334.

Publish interaction 330 provides a mechanism for a service to be made accessible by other entities in the gaming network environment. In order to be accessible, a service needs to publish its description such that the requestor can subsequently find it. Where it is published can vary depending upon the requirements of the application. A service description 322 can be published using a variety of mechanisms known in the art. The various mechanisms used by the varying embodiments of the invention provide different capabilities depending on how dynamic the application using the service is intended to be. The service description may be published to multiple service registries using several different mechanisms. The simplest case is a direct publish. A direct publish means the service provider sends the service description directly to the service requestor. In this case the service requestor may maintain a local copy of the service description 322.

Another means of publishing service descriptions utilized in alternative embodiments of the invention is through a UDDI registry. There are several types of UDDI registries known in the art that may be used depending on the scope of the domain of Web services published to it. When publishing a Web service description to a UDDI registry, it is desirable to consider the business context and taxonomies in order for the service to be found by its potential service consumers. Examples of UDDI registries used in the gaming service architecture of various embodiments of the invention are Internal Enterprise Application UDDI registry, Portal UDDI registry, and Partner Catalog UDDI registry.

An Internal Enterprise Application UDDI registry may be used in some embodiments for gaming services intended for use within an organization for internal enterprise applications integration. For example, all services that provide gaming and gaming management to devices within a casino or casino organization may be published to an Internal Enterprise Application UDDI registry.

A Portal UDDI registry may be used in some embodiments for gaming services that are published by a company for external partners to find and use. A portal UDDI registry typically runs in the service provider's environment outside of a firewall or in a DMZ (de-militarized zone) between firewalls. This kind of private UDDI registry generally contains only those service descriptions that a company wishes to provide to service requestors from external partners through a network. For example, these services may be used to provide online gaming to customers connecting through the World-Wide Web.

A Partner Catalog UDDI registry may be used in some embodiments for gaming services to be used by a particular company. The Partner Catalog UDDI registry can be thought of as a rolodex like UDDI registry. A Partner Catalog UDDI registry is typically located on a computer or gaming machine behind a firewall. This kind of private UDDI registry typically contains approved, tested, and valid service descriptions from legitimate (e.g. authorized) business partners. The business context and metadata for these services can be targeted to the specific requestor. In some embodiments, this type of registry may be used for inter-casino services as well as interactions between casinos and other types of organizations such as regulators and financial institutions. It is desirable that an appropriate authorization and qualification procedure be in place to insure that only approved services are published to service repositories.

In the discover interactions 332 (also referred to as find interactions), the service requestor retrieves a service description directly or queries the registry for the type of service required. It then processes the description in order to be able to bind and invoke it.

As with publishing service descriptions, acquiring service descriptions may vary depending on how the service description is published and how dynamic the service application is meant to be. In some embodiments, service requestors may find Web services during two different phases of an application lifecycle—design time and run time. At design time, service requestors search for web service descriptions by the type of interface they support. At run time, service requestors search for a web service based on how they communicate or qualities of service advertised.

With the direct publish approach noted above, the service requestor may cache the service description at design time for use at runtime. The service description may be statically represented in the program logic, stored in a file, or in a simple, local service description repository.

Service requestors can retrieve a service description at design time or runtime from a Web page (URL), a service description repository, a simple service registry or a UDDI registry. The look-up mechanism typically supports a query mechanism that provides a find by type of interface capability (for example, based on a WSDL template), the binding information (i.e. protocols), properties (such as QOS parameters), the types of intermediaries required, the taxonomy of the service, business information, etc.

The various types of UDDI registries, including those described above, have implications on the number of runtime binding services can choose from, policy for choosing one among many, or the amount of pre screening that will be done by the requestor before invoking the service. Service selection can be based on binding support, historical performance, quality of service classification, proximity, or load balancing. It is desirable that an appropriate authorization and qualification procedure be in place to insure that only approved services are published to service repositories.

Once a service description is acquired, the service requestor will need to process it in order to invoke the service. In some embodiments, the service requestor uses the service description to generate SOAP requests or programming language specific proxies to the service. The generation of such requests can be done at design time or at runtime to format an invocation to the service. Various tools can be used at design time or runtime to generate programming language bindings from interface descriptions, such as WSDL documents. These bindings present an API (Application Program Interface) to the application program and encapsulate the details of the messaging from the application.

After a service has been published 330 and discovered 332, the service may be invoked so that a service requestor and service provider may interact 334. In the interact operation 334, the service requestor invokes or initiates an interaction with the service at runtime using the binding details in the service description 322 to locate, contact, and invoke the service. Examples of service interactions 334 include: single message one way, broadcast from requester to many services, a multi message conversation, or a business process. Any of these types of interactions can be synchronous or asynchronous requests.

In some embodiments of the invention, security mechanisms may be used to secure the Gaming Services Framework 300. Securing the Gaming Services Framework typically involves providing facilities for ensuring the integrity and confidentiality of the messages and for ensuring that a service acts only on requests in messages that express the claims required by policies. Examples of such mechanisms used in various embodiments of the invention include IPSec and SSL/TLS, which provide network and transport layer security between two endpoints. However, when data is received and forwarded on by an intermediary beyond the transport layer both the integrity of data and any security information that flows with it maybe lost. This forces any upstream message processors to rely on the security evaluations made by previous intermediaries and to completely trust their handling of the content of messages. Thus it is desirable to include security mechanisms that provide end-to-end security. It is also desirable that such mechanisms be able to leverage both transport and application layer security mechanisms to provide a comprehensive suite of security capabilities.

Accounting Service

In general, the various embodiments of the invention provide an accounting service for a gaming network. In some embodiments, the accounting service provides a mechanism by which a gaming device may report its game meter information. The service may provide functionality to allow a gaming device to register when it boots. Either periodically, or with every game play, the device may initiate a call to the service to report one or more of its internal meters. The service can then store the information for later accounting and reporting purposes. Internal meters may be segregated by the games available to the device. Other example meters include Credit In Meter, Game Out Meter, Drop Meter, etc.

In some embodiments, an application may wish to retrieve meter information for import to its data store. To accomplish this, the client application may make a call to the service to request meter activity. The service may authenticate the call and return the appropriate meter activity. Activity may be selected based on date range, device, location, game or other criteria. In addition, activity may be selected based on a combination of multiple criteria. For example, an external application can request meters for a particular device at a particular location.

In addition to reporting raw meter information, in some embodiments, the accounting service will also provide the ability to return analytic reports based on the stored information. The service requestor may send a request for a report to the service. The accounting service may authenticate the client and the request. If the request is valid, it will return the requested report. Formatting of the report information will typically be the responsibility of the service requestor. Example reports include: Coin-in/Coin-out Report, Soft-Meter vs. Hard-Meter report, etc.

Figure 5A:
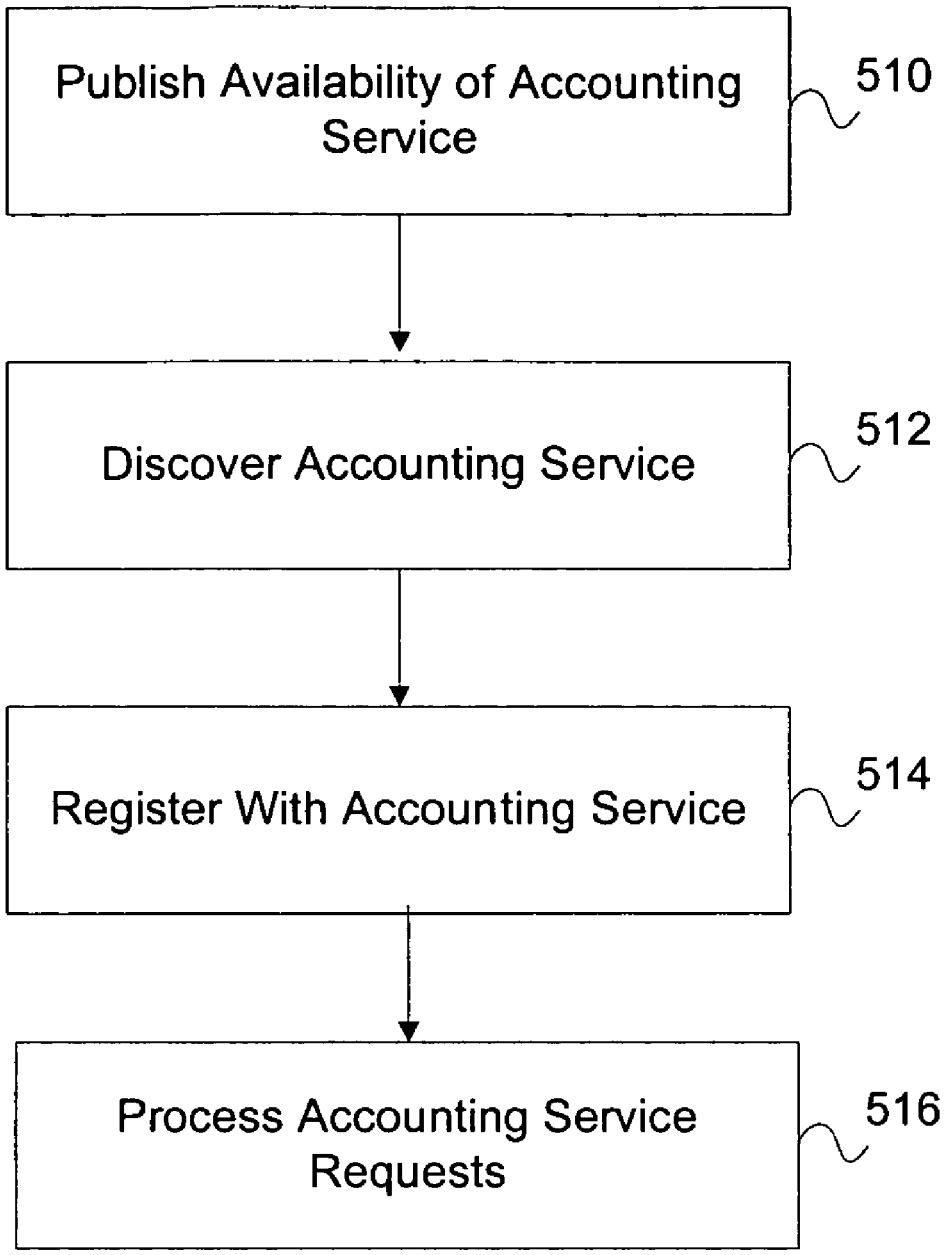
FIGS. 5A and 5B are flow diagrams illustrating methods and message flow for an accounting service according to embodiments of the invention.
Figure 5B:
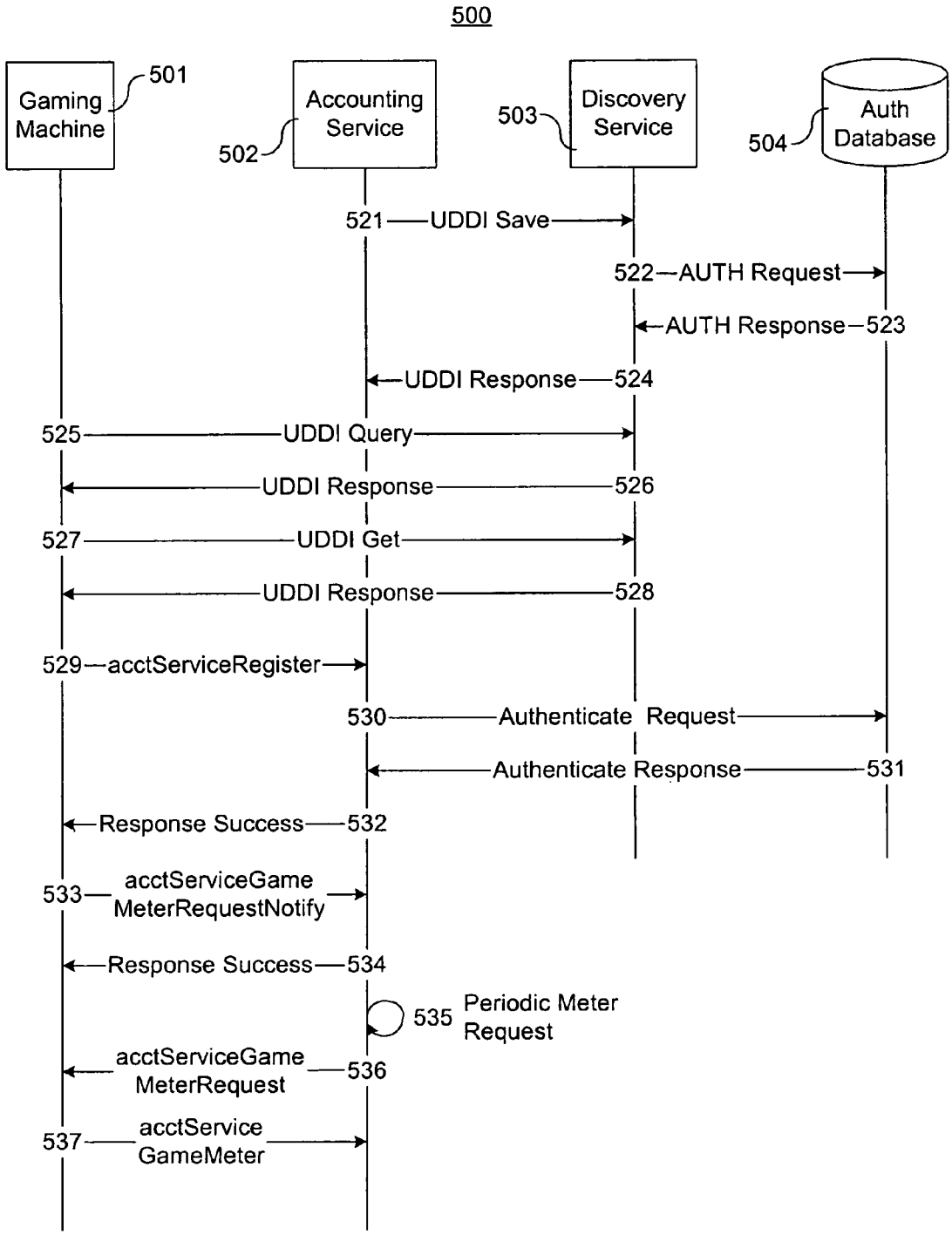

FIGS. 5A and 5B are flow diagrams illustrating methods for providing an accounting service in a gaming network according to embodiments of the invention. The methods may be performed within an operating environment such as that described above with reference to FIGS. 1-4. The methods to be performed by the operating environment constitute computer programs made up of computer-executable instructions. Describing the methods by reference to a flow diagram enables one skilled in the art to develop such programs including such instructions to carry out the methods on suitable computers (the processor of the computer executing the instructions from machine-readable media such as RAM, ROM, CD-ROM, DVD-ROM, flash memory etc.). The methods illustrated in FIGS. 5A and 5B are inclusive of the acts performed by an operating environment executing an exemplary embodiment of the invention.

FIG. 5A is a flow diagram illustrating a method for providing an accounting service in a service-oriented gaming network. In the detailed description of the method below, particular program method names may be provided for particular embodiments of the invention. It should be noted that such names are convenient labels for the method and are exemplary in nature. The present invention is not limited to any functionality that may be implied by the name.

The method begins by publishing the availability of an accounting service on a gaming network (block 510). In some embodiments, the accounting service is described using WSDL and is published to a discovery agency. The discovery agency adds the service description to its UDDI repository. At this point the service is available for discovery by interested parties.

Next, a client/service requestor makes discovery calls for the accounting service (block 512). In some embodiments, a client/service requestor makes UDDI calls to the discovery agency to find an accounting service. The discovery agency returns the service description and location information to the requestor.

Next, a client/service requestor registers with the accounting service provider (block 514). In some embodiments, this is accomplished by invoking an accountingServiceRegister method on the accounting service. In some embodiments, this method call is a SOAP call and includes parameters that identify the client and provide authentication information to the accounting service provider. The accounting service provider will verify that the client is authorized to execute methods in its service before successfully registering the client. When the client is done using the service, it will invoke the accountingServiceDeregister method on the accounting service.

Finally, a client (e.g. a gaming machine, a service requestor or a service provider) can invoke the accounting service to process a request (block 516). In some embodiments, the following methods of the accounting service may be invoked (the methods may be SOAP calls):

accountingServiceGameMeterRequestNotify—The client makes this call to tell the accounting service to notify the client when the accounting service executes a periodic request for gaming device meters. The client is assumed to be a gaming device that has meters to provide to the service.

accountingServiceGameMeterRequestDenotify—The client makes this call to tell the accounting service that the client no longer wants to receive requests for gaming device meters.

accountingServiceGameMeter—The client makes this call to the accounting service to post gaming device meter information. A variety of meters can be collected to track wagering activity, gaming device payouts and monies accepted. The client is assumed to be a gaming device that has meters to provide to the service.

accountingServiceManualAdjustment—The client makes this call to the accounting service to make adjustments to a gaming device's meters.

accountingServiceGetGameMeters—The client makes this call to retrieve information about one or more gaming devices and their corresponding meters.

accountingServiceGetReport—The client makes this call to retrieve and view report information about gaming device meters. A variety of reports can be retrieved allowing the client to analyze meter information.

The accounting service can then communicate with a client that has implemented the appropriate method calls. In some embodiments, the method calls may be RPC calls or they may be SOAP/XML formatted messages sent over a variety of transports such as TCP/IP, MSMQ, MQ Series, JMS, etc. . . . . In a particular embodiment, the method calls comprise an accountingServiceGameMeterRequest where the accounting service server side process communicates using this client method to notify the client to post its gaming device meters to the accounting service.

FIG. 5B illustrates a method according to an embodiment of the invention for providing an accounting service to a client in a gaming machine network. In particular, FIG. 5B illustrates a usage scenario involving a message sequence 500 that describes how an accounting service initiates a transfer of game meters from a gaming device. Message sequence 500 is but one example of a message sequence. Those of skill in the art will appreciate that other message sequences for other types of requests are within the scope of the invention. Additional information for each message is provided below as defined by the reference number in FIG. 5B.

At 521 the Accounting Service 502 is deployed and saves its binding information to the Discovery Service 503 (UDDI Registry).

At 522 the Discovery Service 503 authenticates the Accounting Service 502 with the Authentication/Authorization Database 504 (LDAP, RADIUS, et al.).

At 523 the Authentication/Authorization Database 504 successfully authenticates the Accounting Service 502 (LDAP, RADIUS, et al.).

At 524 the Discovery Service 503 returns a bindingDetail information element to the Accounting Service 502 (UDDI). The Accounting Service 502 is now ready to accept requests for service from clients (Gaming Machines).

At 525 a Gaming Machine 501 contacts the Discovery Service 503 to find the location of an Accounting Service (UDDI).

At 526 the Discovery Service 503 returns with a list of possible Accounting Services (UDDI).

At 527 the Gaming Machine 501 chooses one (using some suitable algorithm) and requests the binding information of that instance of the Accounting Service 502 (UDDI).

At 528 the Discovery Service 503 returns the binding information to the Gaming Machine 501 (UDDI).

At 529 the Gaming Machine 501 registers with the Accounting Service 502 (SOAP).

At 530 the Accounting Service 502 authenticates the Gaming Machine 501 with the Authentication/Authorization Database 504 (LDAP, RADIUS, et al.).

At 531 the Authentication/Authorization Database 504 successfully authenticates the Gaming Machine 501 (LDAP, RADIUS, et al.).

At 532 the Accounting Service 502 returns a successful response to the Gaming Machine 501 (SOAP).

At 533 the Gaming Machine 501 notifies the Accounting Service 502 that it wants to be notified of game meter requests (SOAP).

At 534 the Accounting Service 502 responds with a notify success (SOAP).

At 535 the Accounting Service 502 determines that a periodic request for gaming device meters is required.

At 536 the Accounting Service 502 sends an event notification to the Gaming Machine 501 notifying it of the request for gaming device meters. (SOAP).

At 537 the Gaming Machine 501 posts its meters to the Accounting Service 502.

CONCLUSION

Systems and methods providing an accounting service in a service-oriented gaming network environment have been disclosed. Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention.

The terminology used in this application is meant to include all of these environments. It is to be understood that the above description is intended to be illustrative, and not restrictive. Many other embodiments will be apparent to those of skill in the art upon reviewing the above description. Therefore, it is manifestly intended that this invention be limited only by the following claims and equivalents thereof.

What is claimed is:

1. A method for providing an accounting service in a gaming network including gaming machines, the method comprising:

sending service information for the accounting service from the accounting service to a discovery agent on the gaming network, wherein the accounting service provides a central store for meter information for one or more of a plurality of clients on the gaming network, the clients including a plurality of gaming machines, wherein in response to a wager at a gaming machine of the plurality of gaming machines the gaming machine depicts indicia representative of a randomly selected outcome of a wagering game;

determining by the discovery agent if the accounting service is authentic and authorized;

in response to determining that the accounting service is authentic and authorized, publishing service information to a service repository to make the accounting service available on the gaming network;

receiving by the discovery agent a discovery request for the location of the accounting service from a client of the plurality of clients;

returning the service information for the accounting service to the client;

using the service information for registering by a gaming client with the accounting service;

determining by the accounting service if the gaming client is authentic and authorized to use the accounting service; and processing one or more service requests between the gaming client and the accounting service, said service requests conforming to an internetworking protocol, wherein the requests include requests associated with meter information for at least one gaming machine.

2. The method of claim 1, wherein the accounting service comprises a web service.

3. The method of claim 2, wherein the service request is formatted according to a service description language.

4. The method of claim 3, wherein the service description language is a Web Services Description Language (WSDL).

5. The method of claim 2, wherein the accounting service is registered in a UDDI registry.

6. The method of claim 1, wherein the gaming client comprises a gaming machine.

7. The method of claim 1, wherein the gaming client comprises a service provider.

8. The method of claim 1, wherein the service request comprises a request by the gaming client to start receiving requests by the accounting service for gaming machine meters on the gaming client.

9. The method of claim 1, wherein the service request comprises a request by the gaming client to stop receiving requests for gaming machine meters on the gaming client.

10. The method of claim 1, wherein the service request comprises a request by the gaming client to post gaming meter information.

11. The method of claim 1, wherein the service requests comprises a request by the gaming client to adjust gaming machine meter information maintained by the accounting service.

12. The method of claim 1, wherein the service requests comprises a request by the gaming client to retrieve information about gaming device meters on a gaming device.

13. The method of claim 1, wherein the service request comprises a request by the gaming client to retrieve report information about gaming device meters.

14. A gaming network system providing an accounting service, the gaming network system comprising:

an accounting service communicably coupled to the gaming network and operable to provide a central store for meter information for one or more of a plurality of gaming clients on the gaming network, the clients including a plurality of gaming machines; and a discovery agent communicably coupled to the gaming network, wherein the discovery agent is operable to:

receive service information from the accounting service, determine if the accounting service is authentic and authorized for the gaming network, and publish the service information to a service repository to make the accounting service available on the gaming network;

wherein a gaming client of the plurality of gaming clients on the gaming network issues a request for the location of the accounting service to the discovery agent and uses the service information received from the discovery agent to register the gaming client with the accounting service and further to issue one or more service requests to the accounting service, said service requests conforming to an internetworking protocol.

15. The gaming network system of claim 14, wherein the accounting service comprises a web service.

16. The gaming network system of claim 15, wherein the service request is foil fatted according to a service description language.

17. The gaming network system of claim 16, wherein the service description language is a Web Services Description Language (WSDL).

18. The gaming network system of claim 14, wherein the accounting service is registered in a UDDI registry.

19. The gaming network system of claim 14, wherein the gaming client comprises a gaming machine.

20. The gaming network system of claim 14, wherein the gaming client comprises a service provider in the gaming network.

21. The gaming network system of claim 14, wherein the service request comprises a request by the gaming client to start receiving requests by the accounting service for gaming machine meters on the gaming client.

22. The gaming network system of claim 14, wherein the service request comprises a request by the gaming client to stop receiving requests for gaming machine meters on the gaming client.

23. The gaming network system of claim 14, wherein the service request comprises a request by the gaming client to post gaming meter information.

24. The gaming network system of claim 14, wherein the service request comprises a request by the gaming client to adjust gaming machine meter information maintained by the accounting service.

25. The gaming network system of claim 14, wherein the service request comprises a request by the gaming client to retrieve information about gaming device meters on a gaming device.

26. The gaming network system of claim 14, wherein the service request comprises a request by the gaming client to retrieve report information about gaming device meters.

* * * * *

UNITED STATES PATENT AND TRADEMARK OFFICE

CERTIFICATE OF CORRECTION

PATENT NO. : 7,927,210 B2
APPLICATION NO. : 10/802699
DATED : April 19, 2011
INVENTOR(S) : Christopher W. Blackburn et al.

It is certified that error appears in the above-identified patent and that said Letters Patent is hereby corrected as shown below:

On the Cover page, Item (75), in "Inventors", in column 1, line 3, delete "Reno, NV (US)" and insert -- Sparks, NV (US) --, therefor.

On page 2, under "Foreign Patent Documents", in column 2, line 1, delete "5/2003" and insert -- 6/2003 --, therefor.

On page 3, under "Other Publications", in column 1, line 13, after "Final" delete "Action" and insert -- Office --, therefor.

On page 3, under "Other Publications", in column 2, line 6, delete "Systems" and insert -- Services --, therefor.

On page 3, under "Other Publications", in column 2, line 7, delete "41(52)," and insert -- 41(2), --, therefor.

In column 14, line 15, delete "meters. (SOAP)." and insert -- meters (SOAP). --, therefor.

In column 16, line 14, in Claim 16, delete "foil fatted" and insert -- formatted --, therefor.

Signed and Sealed this
Twentieth Day of September, 2011

David J. Kappos

David J. Kappos
*Director of the United States Patent and Trademark Office*